United States Patent [19]

Nakahara et al.

[11] 4,387,487

[45] Jun. 14, 1983

[54] HIGH DRAFT APPARATUS IN SPINNING MACHINE

[75] Inventors: Teiji Nakahara, Ujishi; Toshifumi Morihashi, Ohtsushi; Teruo Nakayama, Ohtsushi; Shinichi Nishimura, Ohtsushi; Hisaaki Kato, Shigaken; Ikuzo Uematsu, Kyotoshi; Takashi Yoshioka, Kyotofu, all of Japan

[73] Assignee: Murata Kikai Kabushiki Kaisha, Japan

[21] Appl. No.: 196,480

[22] Filed: Oct. 14, 1980

[30] Foreign Application Priority Data

Oct. 16, 1979 [JP] Japan ..... 54-133979
Oct. 25, 1979 [JP] Japan ..... 54-138494

[51] Int. Cl.[3] ..... D01H 5/88

[52] U.S. Cl. ..... 19/249; 19/252; 19/256; 57/315; 57/328

[58] Field of Search ..... 57/297, 328, 315; 19/244, 247–253, 256

[56] References Cited

U.S. PATENT DOCUMENTS

| | | | |
|---|---|---|---|
| 2,239,863 | 4/1941 | Schlipp | 19/249 |
| 2,319,367 | 5/1943 | Schlums | 19/256 X |
| 2,695,428 | 11/1954 | Naegeli | 19/250 |
| 3,126,585 | 3/1964 | Tabor et al. | 19/244 |
| 4,112,658 | 9/1978 | Morihashi | 57/328 |
| 4,183,202 | 1/1980 | Morihashi | 57/328 |

FOREIGN PATENT DOCUMENTS

| | | | |
|---|---|---|---|
| 908949 | 4/1954 | Fed. Rep. of Germany | 19/244 |
| 1112433 | 8/1961 | Fed. Rep. of Germany | 19/248 |
| 838534 | 12/1938 | France | 19/249 |
| 43-6336 | 3/1968 | Japan | 19/250 |

*Primary Examiner*—John Petrakes
*Attorney, Agent, or Firm*—Barnes, Kisselle, Raisch, Choate, Whittemore & Hulbert

[57] ABSTRACT

A high draft apparatus in a spinning machine for forming a spun yarn from a roving or sliver. The draft apparatus comprises back rollers, apron-provided middle rollers and front rollers and a gripping and a pressing means for a sliver disposed on the front end portion of the apron so that the arrangement of fibers in the drafted sliver is regulated and a high draft ratio can be attained.

9 Claims, 8 Drawing Figures

HIGH DRAFT APPARATUS IN SPINNING MACHINE

BACKGROUND OF THE INVENTION

The draft apparatus is indispensable for a spinning machine, and various trials have been made in connection with adapting the draft apparatus to be adapted to a ring spinning machine. A most important problem in the draft apparatus is how to reduce the draft unevenness having fatal influences on the yarn quality (uniformity, tenacity and the like).

According to the conventional drafting method, drafting is gradually accomplished through the roving step and the subsequent spinning step. However, because of the complicated process steps, this conventional method involves various disadvantages, for example, difficulty in maintenance and low productivity.

A five-line or six-line system omitting the roving step was once tried at a certain time after the Second World War. However, as is seen from the thesis entitled "Glories and Failures in Continuous Spinning" published in The Journal of the Japanese Association of Textile Machines (No. 2, 1979) five-line or six-line system draft apparatuses omitting the roving steps were proposed as new machines meeting the requirements in the art, but these attempts all met with failure. It is stated in the above thesis that even if an experimental operation is successful at such a high draft ratio as 400, in the actual operation the precise maintenance or control of the draft apparatus is very difficult, and various problems involved in the draft apparatus are pointed out in the thesis.

The spinning speed varies depending on whether the spinning machine is a ring spinning machine or a pneumatic spinning machine. It is said that in case of yarns of British count number of Ne 45, the highest spinning speed in the ring spinning method is 13 to 15 m/min and the highest spinning speed in the pneumatic spinning method is 180 to 200 m/min. The peripheral speed of the front roller of the draft apparatus is naturally determined according to this spinning speed, and the peripheral speed of the front roller is a value approximating to the spinning speed, though the value is changed to extent depending on such factors as the draft ratio. The following relation is established among the draft ratio D, the peripheral speed FV of the front roller and the peripheral speeds $NV_1$, $NV_2$, . . . $NV_n$ of other rollers:

$$D = FV/MV_{1\sim n}$$

From the above formula, it will readily be understood that the peripheral speeds of the respective rollers satisfy the requirement of $FV > MV_{1\sim n}$ and the peripheral speed of the front roller is much higher than the peripheral speeds of other rollers.

An air stream is produced in the vicinity of the nip point of each roller according to the peripheral speed of the roller. In the vicinity of the nip point of the front roller rotating at a much higher speed than the speeds of other rollers, a turbulent stream is produced, while laminar streams are produced in the vicinity of the nip points of other rollers.

The fiber arrangement of the sliver is disturbed by this turbulent stream and fibers are scattered, resulting in formation of fibers in which both the ends are not restricted but kept free or hooked fibers, and an undesirable phenomenon of abnormal expansion of the sliver width is often caused to occur.

The quantity of waste cotton is increased by such phenomenon and since hooked fibers are twisted in the hooked state, the tenacity of the resulting spun yarn is reduced and thick portions and thin portions are often formed in the spun yarn, resulting in reduction of uniformity. Moreover, the fibers which are twisted in the state where both the ends are not restricted but kept free make no contribution to the tenacity of the spun yarn, but they have bad influences on the yarn quality. For example, such fibers cause reduction of the uniformity and degrade the feel and touch of the spun yarn.

SUMMARY OF THE INVENTION

The present invention relates to a draft apparatus in spinning machines for forming a spun yarn from a roving or sliver and more particularly relates to a three-line system draft apparatus in which the roving step is successfully omitted.

An object of the present invention is to provide a draft apparatus by which the drafting operation at a high draft ratio of about 200 to 400 can be performed, and in which disturbance of arrangement of fibers in the draft zone and abnormal expansion of the sliver width are effectively prevented.

The draft apparatus of the present invention can be applied to not only a ring spinning machine but also a pneumatic spinning machine. Especially valuable effects can be attained when the draft apparatus of the present invention is applied to a pneumatic spinning machine where spinning is possible at a speed at least 10 times as high as the spinning speed attained in the ring spinning machine.

The high draft apparatus of the present invention comprises back rollers, apron-provided middle rollers and front rollers being arranged in succession along a yarn passage includes a gripping and pressing means for a sliver which is disposed on the front end portion of the apron so that an occurrence of the draft unevenness is controlled, the fiber-controlling force is increased and a layer of regularly arranged fibers is formed. Furthermore, according to the present invention, the nip point of the top end of the apron of the high draft apparatus is displaced from the nip point of the front roller to eliminate influences of air streams produced in the vicinity of the nip point of the front roller, whereby occurrence of disturbance of the fiber arrangement, formation of flying fibers and abnormal expansion of the sliver width can be prevented effectively and the triangle state formed in the feed-out zone of the front roller can be stably maintained so that it has always a constant size. Therefore, occurrence of waste fibers in which both the ends are not restricted but keep free or more winding of such fibers around the periphery of the formed spun yarn can be prevented, and simultaneously, winding of hooked fibers can be reduced.

Accordingly, a spun yarn excellent in both uniformity and tenacity can be obtained.

DETAILED DESCRIPTION OF THE INVENTION

The present invention will now be described with reference to embodiments illustrated in the accompanying drawings.

Figure 1:
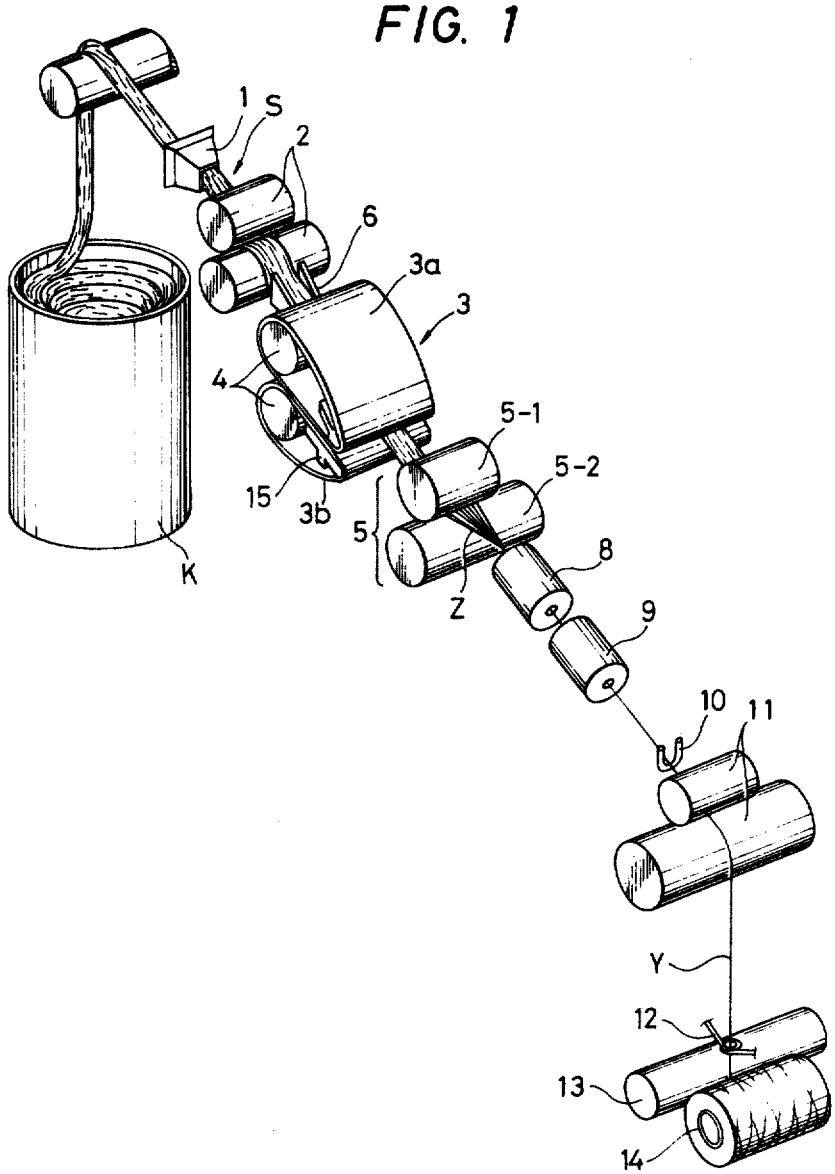
FIG. 1 is a diagram illustrating a process for preparing spun yarns.

Referring to FIG. 1 illustrating the process for preparing spun yarns, a sliver S taken out from a can K through a guide 1 is passed through a pair of upper and lower back rollers 2 which are positively rotated in the state where one ends of the peripheries of the back rollers 2 are pressed to each other, apron-provided middle rollers 4 and front rollers 5. Thus, the sliver is directly drafted without passing through the roving step and is guided to take-up rollers 11 passing through the pneumatic spinning device. The peripheral speed is different among the above-mentioned three kinds of rollers 2, 4 and 5, and the sliver is gradually drafted according to this difference of the peripheral speed.

The peripheral speeds of the respective rollers at this point can be expressed as follows:

Speeds of back roller 2 < Speeds of middle roller 4 < Speeds of front roller 5

Therefore, the draft ratio is determined according to the ratio of the peripheral speeds among these rollers.

When the sliver S is passed through between the rollers rotated in the press-contact state, the sliver is flatly expanded by the pressing force of the rollers. Accordingly, an adjusting guide 6 for adjusting the expanded width of the sliver is disposed between the back rollers 2 and the middle rollers 4.

Figure 2:
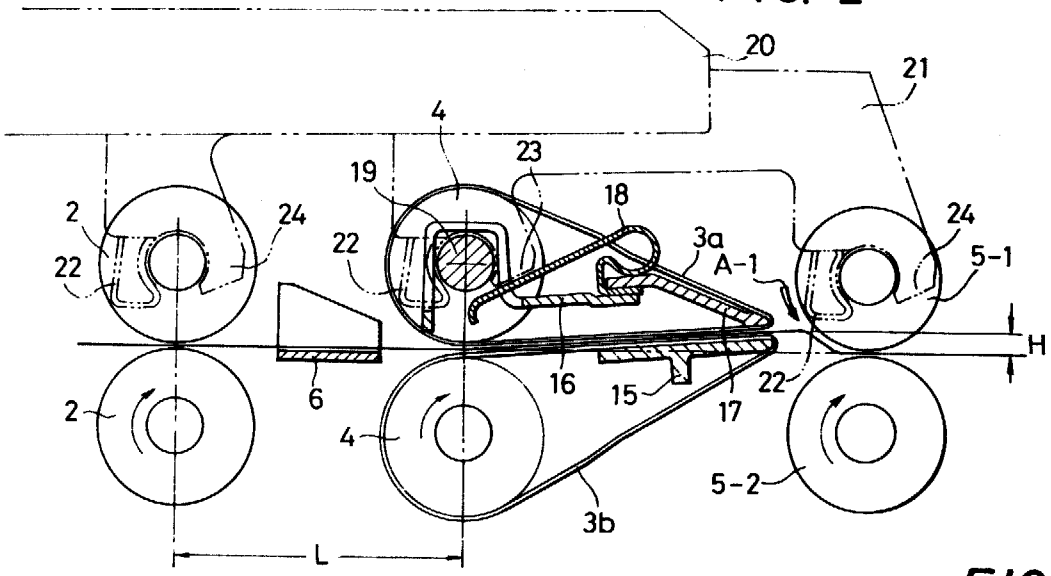
FIG. 2 is a side view of a high draft apparatus.
Figure 4:
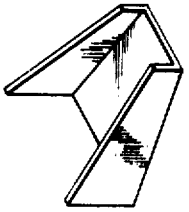
FIG. 4 is a perspective view showing an adjusting guide.
Figure 3:
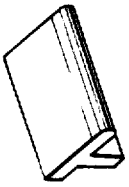
FIG. 3 is a perspective view illustrating diagrammatically a tenser bar.

The draft apparatus at the above-mentioned drafting step is illustrated in details in FIGS. 2 to 4. The above-mentioned adjusting guide 6 is disposed between rollers 2 and 4 differing in peripheral speed. The adjusting guide 6 has a dustpan-like shape as shown in FIG. 4. If the outlet width of the guide 6 is too large, the sliver S is expanded too much in the draft zone, and the uniformity is degraded in a spun yarn formed by a pneumatic spinning device including two air nozzles described hereinafter. In contrast, if the outlet width is too narrow, fibers F1 of the sliver S are packed too densely and the number of contact points among the fibers is increased, with the result that acceleration of floating fibers by surrounding fibers moved at a high speed is increased and the draft unevenness becomes conspicuous. Accordingly, the outlet width of the adjusting guide 6 is set so that the width of the sliver in the front roller zone is about 2 to about 7 mm when the yarn count number is Ne 35.

An apron 3 attached to the above-mentioned middle rollers 4 has an endless belt-like shape and comprises an upper apron 3*a* and a lower apron 3*b*. The upper and lower aprons 3*a* and 3*b* are gripped and pressed to each other and they are moved in this state with rotation of the middle rollers 4. Draft unevenness is often caused according to the gripping force and position of the upper and lower aprons 3*a* and 3*b*. As means for eliminating this draft unevenness, a tenser bar 15 having a T-shaped cross-section as shown in FIG. 3 (in this case, the upper face for gripping is important and the shape is not particularly limited to the T-figured shape) and being fixed to a fixing bar (not shown) is disposed on the inner side of the front end of the lower apron 3*b*. The front end of a cradle 17 is urged to the inner side of the front end of the upper apron 3*a* by a spring 18 and is urged in the pressed state toward the tenser bar 15 so that the front end portions of the upper and lower aprons 3*a* and 3*b* are always gripped and pressed between the tenser bar 15 and the cradle 17. More specifically, the cradle 17 of which one end is free and the spring 18 of which one end is free are integrally fixed to one end of a hanging piece 16 hung on a shaft 19, and formed to have an inverse U-figured shape. As in the known apparatus, a spring 22 is fixed to a bearing 21 which can be locked to a roller support 20, and the shaft 19 integrated with the cradle 17. Roller 4 is dismountably gripped and supported by the spring 22 and the end portion 23. When the bearing 21 is locked by the roller support 20, the lower end portion 23 of the bearing 21 is brought into butting contact with one end of the spring 18, whereby the cradle 17 is pressed to the tenser bar 15.

By provision of the above-mentioned gripping and pressing means on the front end portion of the apron, formation of floating fibers is controlled and occurrence of draft unevenness is prevented. Furthermore, a certain tension is caused to act on the sliver S between the front end portion of the apron and the front roller 5, whereby diffusion and scattering of fibers can be prevented in the gripping region of the apron and layers of regularly arranged fibers can be formed. Moreover, since the spinning tension between the front roller 5 and the nip roller 11 is naturally increased, the triangle state Z of the sliver S produced in the sliver feed-out zone of the front roller 5 is stabilized.

The sliver S which has been drafted between the back roller 2 and the middle roller 4 is passed through the apron 3 and is further drafted by the front roller 5. If the nip point on the front end of the apron 3 mounted on the middle roller 4 is positioned at the same height as that of the nip point of the front roller 5, the sliver S which has been passed through the apron 3 undergoes an action of an air stream produced in the vicinity of the nip point of the front roller 5 rotated at a high speed, with the result that the fiber arrangement of the sliver S is disturbed to form floating fibers and the width of the sliver S is abnormally expanded.

Figure 5:
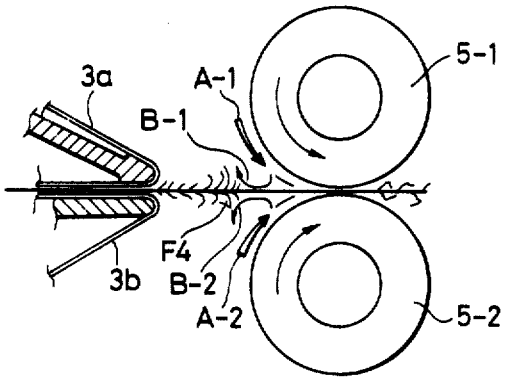
FIG. 5 and FIG. 6 are diagrams illustrating air streams produced in the vicinity of the nip point of a front roller.

The flowing course of the above-mentioned air stream will now be described. The above-mentioned air stream is branched into two streams. One stream produces accompanying streams A-1 and A-2 flowing along the peripheral faces of top front roller 5-1 and bottom front roller 5-2 as shown in FIG. 5, and these accompanying streams A-1 and A-2 impinge against each other in the vicinity of the nip point of the top front roller 5-1 and bottom front roller 5-2 to produce repulsive streams flowing in directions indicated by arrows B-1 and B-2. The fiber arrangement of the sliver S is disturbed by these repulsive streams to cause flying and scattering in fibers F1, whereby fibers in which both the ends are not restricted but kept free or fibers having the front ends hooked are formed.

Figure 6:
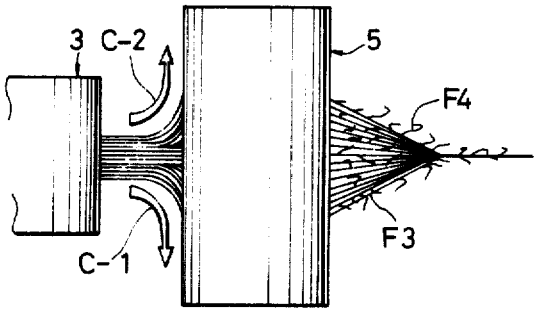

As shown in FIG. 6, the accompanying streams A-1 and A-2 flowing along the peripheral faces of the top front roller 5-1 and bottom front roller 5-2 produce repulsive streams flowing in directions indicated by arrows B-1 and B-2 in the same manner as described above. Simultaneously, the streams are divided into directions C-1 and C-2 outwardly perpendicularly to the yarn passage. By these air streams, the width of the sliver is abnormally expanded or the fiber arrangement is disturbed to form fibers where both the ends are not restricted but kept free.

Figure 7:
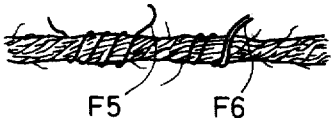
FIG. 7 is a diagram illustrating the state where fibers in which both the ends are not restricted but kept free and hooked fibers are wound around the periphery of a spun yarn.

Accordingly, as shown in FIG. 7 illustrating the resulting spun yarn Y, the so formed fibers where both the ends are not restricted but kept free F3 fall down as waste cotton or are merely wound F5 on the yarn Y. The fibers F5 merely wound on the yarn have no substantial contribution to the yarn tenacity but form neps or the like, resulting in reduction of the yarn quality. Since fibers F4 having the front ends hooked are twisted in such hooked state F6, the effective winding length of the fibers is reduced and also the yarn tenacity is reduced, and thick portions are readily formed in the yarn. Moreover, by abnormal expansion of the width of the sliver, the fiber density becomes irregular. The foregoing causes are combined, and the yarn quality is reduced and the feel and touch of the yarn are worsened.

According to the present invention, in order to prevent occurrence of the above-mentioned undesirable phenomena, the height of the tener bar 15 is displaced and offset "H" with respect to the nip point of the front rollers 5 so that the sliver S which has been passed through the apron 3 is carried on the accompanying stream A-1 produced with rotation of the top front roller 5-1 and is fed to the nip point of the front rollers 5 without abnormal expansion of the width of the sliver S or disturbance of the fiber arrangement. From the results of experiments, it has been confirmed that when the yarn count number is British Ne 45 and the spinning speed is 180 to 200 m/min in a pneumatic spinning device or is 13 to 15 m/min in a ring spinning device, if the offset value H is set at 1.5 to 5 mm, a highest effect is obtained.

By adoption of the above arrangement according to the present invention, the uniformity and tenacity of the spun yarn can be improved. Of course, the displacement direction is not limited to an upward direction as in the foregoing embodiment, but the displacement direction may be a downward direction. It is preferred that the front end portion of the apron be brought as close to the front roller 5 as possible.

The quantity of the draft unevenness is changed according to the break draft ratio between the back roller 2 and the middle roller 4, the main draft ratio distribution between the middle roller 4 and the front roller 5 and the roller guage L between the back roller 2 and the middle roller 4. In the foregoing embodiment, a spun yarn excellent in both uniformity and tenacity is obtained when the main draft ratio is adjusted to 20 to 70. If the main draft ratio is below the above range, the yarn tenacity is reduced, and if the main draft ratio is beyond the above range, the uniformity is worsened.

It will be illustrated the draft apparatus of the present invention is applied to the pneumatic spinning machine.

The fiber S continuously fed by the above-mentioned high draft apparatus is guided to two fluid jet nozzles 8 and 9 arranged between the front roller 5 and the nip roller 11 and rotated in directions opposite to each other, and ballooning is caused by the first fluid jet nozzle 8 and the spun yarn is twisted by the second fluid jet nozzle 9. Strong false twists imparted to the sliver S by the second fluid nozzle 9 are loosened to such an extent that no yarn breakage is caused and loosened twists are transmitted to the feed-out zone of the front roller 5. In this zone, the action of the first fluid jet nozzle 8 is imposed in good balance with the above-mentioned loosened twisting so that no yarn breakage is caused, whereby the twists are released. When the yarn passes through the second fluid jet nozzle 9, the retwisting action is given to the yarn, whereby a spun yarn Y having true twists formed thereon is obtained. The resulting spun yarn Y passes through a yarn guide 10 and is positively taken out by the take-up roller 11 and wound on a package 14 through a traverse guide 12 and a friction roller 13.

Figure 8:
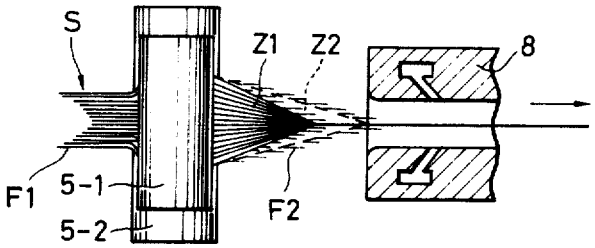
FIG. 8 is a diagram illustrating the triangle state produced in the feed-out zone of the front roller.

FIG. 8 illustrates the triangle state Z of the sliver S produced in the feed-out zone of the front roller 5. The force of controlling fibers F1 is increased by the above-mentioned gripping and pressing means disposed on the top end portion of the apron, and layers of regular fiber arrangements can be formed. Furthermore, by increase of the tension between the front roller 5 and the take-up roller 11, the triangle portion Z1 of the sliver S is stably produced so that the size Z2 of the triangle portion Z1 is always kept constant.

Moreover, since disturbance of the fiber arrangement in the sliver S, formation of flying fibers and abnormal expansion of the width of the sliver are inhibited by the displacement of the tenser bar 15 by the offset value H with respect to the nip point of the front roller 5, the triangle portion Z1 of the sliver S is stably produced in the feed-out zone of the front roller 5 so that the size Z2 of the triangle portion Z1 is always kept constant. Furthermore, hooking of the front ends of fibers is effectively prevented and the open end ratio is increased in the fibers F2. Accordingly, the functions of the fluid jet nozzles 8 and 9 are exerted very effectively, and a spun yarn Y excellent in the tenacity and uniformity can be obtained. In the foregoing embodiment, a pneumatic spinning machine comprises two fluid jet nozzles 8,9 rotated in directions opposite to each other. However, the present invention can effectively be applied to other spinning machines, for example, a spinning machine comprising other air nozzles and a ring spinning machine.

As will readily be understood from comparative experiment results shown below, a yarn excellent in the uniformity and tenacity can be obtained with much reduced neps according to the present invention, and the productivity can be enhanced according to the present invention.

Sinning Conditions:

Polyester/cotton ratio: 65/35
Polyester: 15 denier, cut into 38 mm
Fed sliver S: 320 grains/6 yards
Soun yarn count number: Ne 40
Break draft ratio: 5.0
Main draft ratio: 51.2
Sum of break draft ratio and main draft ratio: 256

| | Run A Tenser guage: 3 mm Apron top end grip pressure: 0 Kg | Run B Tenser guage: 0 Apron top end grip pressure: 1.5 Kg | Run C Tenser gauge: 0 Apron top end grip pressure: 1.5 Kg Offset value: 2.3 mm |
|---|---|---|---|
| Number of thin protions of yarn per 1000 m | 344 | 72 | 18 |
| Number of thick protions of yarn per 1000 m | 200 | 40 | 19 |
| Number of neps per 1000 m | 280 | 80 | 24 |
| Average deviation (μ %) | 16.2% | 13.5% | 11.8% |

Note
Run A: comparison
Run B: one embodiment of the present invention
Run C: another embodiment of the present invention

What is claimed is:

1. A high draft apparatus in a spinning machine comprising back rollers, a width adjusting guide, apron-provided middle rollers and front rollers which are arranged in succession along a yarn passage characterized in that the draft apparatus further includes a gripping and pressing means disposed on the front end of the apron which gripping and pressing means comprises a tenser bar having a T-shaped cross section which is fixed to a fixing bar and is disposed on the inner side of the front end of the lower apron, and a cradle which is urged toward the inner side of the front end of the upper apron by a spring and is urged in the pressed state toward the tenser bar.

2. A high draft apparatus as claimed in claim 1, wherein the nip point of the front end of the apron is displaced from the nip point of the front rollers in the vertical direction along the yarn passage.

3. A high draft apparatus as claimed in claim 2, wherein the offset value at the displaced nip point of the front roller is in the range of 1.5 to 5 mm.

4. Structure as set forth in claim 1, wherein the outlet width of the width adjusting guide is between 2 and 7 mm with a yarn count number of yarn being spun of Ne 35.

5. Structure as set forth in claim 1, wherein the main draft ratio is between 20 and 70.

6. A high draft apparatus in a spinning machine having a main draft ratio between 20 and 70 comprising back rollers, upper and lower middle rollers provided with an apron and front rollers which are arranged in succession along a yarn passage, characterized in that the nip point of the front end of the apron is displaced from the nip point of the front rollers in a vertical direction along the yarn passage and in that the apron comprises a pair of endless belts which at the back end of the apron extend over the upper and lower middle rollers, a fixed position tenser bar having a T-shaped cross-section disposed inside of the front end of the lower apron, a cradle disposed on the inside of the front end of the upper apron and a spring held in a fixed position holding the cradle and resiliently urging the cradle toward the front end of the upper apron and toward the tenser bar.

7. Structure as set forth in claim 6, wherein the upper and lower aprons have a nip point at the front end thereof which is displaced from the nip point of the front rollers in the vertical direction along the yarn passage a distance of between 1.5 to 5 mm.

8. Structure as set forth in claim 6, and further including a width adjusting guide which is substantially in the shape of an inverted U having a narrower U-shaped cross-section at the front thereof than at the back positioned between the back rollers and the middle rollers.

9. Structure as set forth in claim 8, wherein the width of the adjusting guide is such that the width of the sliver of yarn being spun in the front roller zone is between 2 mm to 7 mm when the yarn count number is Ne 35.

* * * * *